US010005196B2

(12) United States Patent
Yamamoto et al.

(10) Patent No.: US 10,005,196 B2
(45) Date of Patent: Jun. 26, 2018

(54) CUTTING APPARATUS

(71) Applicant: Roland DG Corporation, Hamamatsu-shi, Shizuoka (JP)

(72) Inventors: Shinya Yamamoto, Hamamatsu (JP); Takeshi Tozuka, Hamamatsu (JP); Yuichi Kitagawa, Hamamatsu (JP); Tadashi Kawashima, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 23 days.

(21) Appl. No.: 15/254,142

(22) Filed: Sep. 1, 2016

(65) Prior Publication Data

US 2017/0066152 A1 Mar. 9, 2017

(30) Foreign Application Priority Data

Sep. 4, 2015 (JP) ..... 2015-174914

(51) Int. Cl.
*B26D 5/38* (2006.01)
*B26D 5/00* (2006.01)
*B26D 1/10* (2006.01)

(52) U.S. Cl.
CPC ..... *B26D 5/38* (2013.01); *B26D 5/00* (2013.01); *B26D 5/005* (2013.01); *B26D 1/105* (2013.01)

(58) Field of Classification Search
CPC ..... B26D 1/105; B26D 1/00; B26D 1/005; B26D 1/38; B26D 5/02; B26D 5/08
USPC ..... 83/623, 624, 617, 614
See application file for complete search history.

(56) References Cited

U.S. PATENT DOCUMENTS

2012/0247297 A1* 10/2012 Kawaguchi ..... B26D 5/005 83/375
2013/0255458 A1* 10/2013 Kawase ..... B26D 5/005 83/76.1
2014/0260855 A1* 9/2014 Tokura ..... B26D 5/007 83/76.6
2016/0031109 A1* 2/2016 Abe ..... B26D 5/005 83/75.5
2016/0297212 A1* 10/2016 Saiga ..... B41J 11/663
2017/0190071 A1* 7/2017 Abe ..... B26D 5/007

FOREIGN PATENT DOCUMENTS

JP 07-276293 A 10/1995

* cited by examiner

*Primary Examiner* — Omar Flores Sanchez
(74) *Attorney, Agent, or Firm* — Keating & Bennett, LLP

(57) ABSTRACT

A cutting apparatus includes a first motor to move a carriage, a second motor to cause a cutter to approach a work material, and a controller configured or programmed to control the first motor and the second motor. The controller includes a load detector to detect a load of the first motor, a storage storing a first relationship between the load of the first motor and a supply signal to the second motor, and a cutting pressure controller configured or programmed to control a cutting pressure applied from the cutter to the work material based on the first relationship and the load of the first motor detected by the load detector.

16 Claims, 12 Drawing Sheets

CUTTING APPARATUS

CROSS REFERENCE TO RELATED APPLICATIONS

The present application claims priority from Japanese Patent Application No. 2015-174914, filed on Sep. 4, 2015, which is incorporated by reference herein in its entirety.

BACKGROUND OF THE INVENTION

1. Field of the Invention

The present invention relates to a cutting apparatus suitable for cutting a sheet, a plate-shaped material, or the like.

2. Description of the Related Art

A cutting apparatus has conventionally been known to include a carriage configured to be movable two-dimensionally against a work material, such as a paper sheet, and a cutter mounted to the carriage (see, for example, JP 1995-276293 A). Among this type of cutting apparatus, one type of the apparatus in which the cutter is moved vertically by a voice coil motor is also known. A cutting apparatus having a motor capable of controlling cutting pressure is allowed to freely set the speed of relative movement of a carriage equipped with a cutter against the work material (which will be hereinafter referred to as "cutting speed" as appropriate), and also set the pressure of the cutter against the work material, i.e., the cutting pressure. It should be noted that the term "cutting" used in the present description is meant to include partial cutting of a work material across its thickness, as well as cutting of the work material across its entire thickness.

Although the conventional cutting apparatuses can freely set the cutting pressure and the cutting speed, it is difficult to set an appropriate cutting pressure depending on the thickness or hardness of the work material. For example, when the operator is going to cut a thick work material, the cutting pressure should be set relatively higher or the cutting speed to be slower than a usual setting, and such setting adjustment may be done based on the experience and intuition of the operator. Alternatively, the operator may need to perform a so-called two-times cutting operation, in which the work material is cut to half the thickness thereof in the first time process and the remaining half-thickness portion thereof is cut in the second or subsequent process, without making the cutting pressure higher than a certain pressure. As a consequence, the cutting work takes a lot of work and becomes very troublesome, reducing work efficiency.

SUMMARY OF THE INVENTION

Preferred embodiments of the present invention provide a cutting apparatus that makes it possible to improve work efficiency.

A cutting apparatus according to a preferred embodiment of the present invention includes a cutter to cut a work material; a holder to support the cutter so as to enable the cutter to approach toward and move away from the work material; a carriage to support the holder and being movable relatively to the work material; a first motor coupled to the carriage to cause the carriage to move relatively to the work material; a second motor coupled to the holder to impart a force to the holder at least in a direction approaching toward the work material; and a controller configured or programmed to control the first motor and the second motor, wherein the second motor is capable of changing the force to be imparted to the holder according to a supply signal supplied to the second motor; and the controller is configured or programmed to include a load detector to detect a load of the first motor; a storage to store a first relationship that is a predetermined relationship between the load of the first motor and the supply signal to the second motor; and a cutting pressure controller configured or programmed to control a cutting pressure applied from the cutter to the work material by supplying the supply signal to the second motor based on the load of the first motor detected by the load detector and the first relationship stored in the storage.

Another cutting apparatus according to a preferred embodiment of the present invention includes a cutter to cut a work material; a holder to support the cutter so as to enable the cutter to approach toward and move away from the work material; a carriage to support the holder and being movable relatively to the work material; a first motor coupled to the carriage to cause the carriage to move relatively to the work material; a second motor coupled to the holder to impart a force to the holder at least in a direction approaching toward the work material; and a controller configured or programmed to control the first motor and the second motor, wherein the second motor is capable of changing the force to be imparted to the holder according to a supply signal supplied to the second motor; and the controller is configured or programmed to include a load detector to detect a load of the first motor; a storage to store a second relationship that is a predetermined relationship between the load of the first motor and the supply signal to the first motor; and a cutting speed controller configured or programmed to control a cutting speed for the work material by supplying the supply signal to the first motor based on the load of the first motor detected by the load detector and the second relationship stored in the storage.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
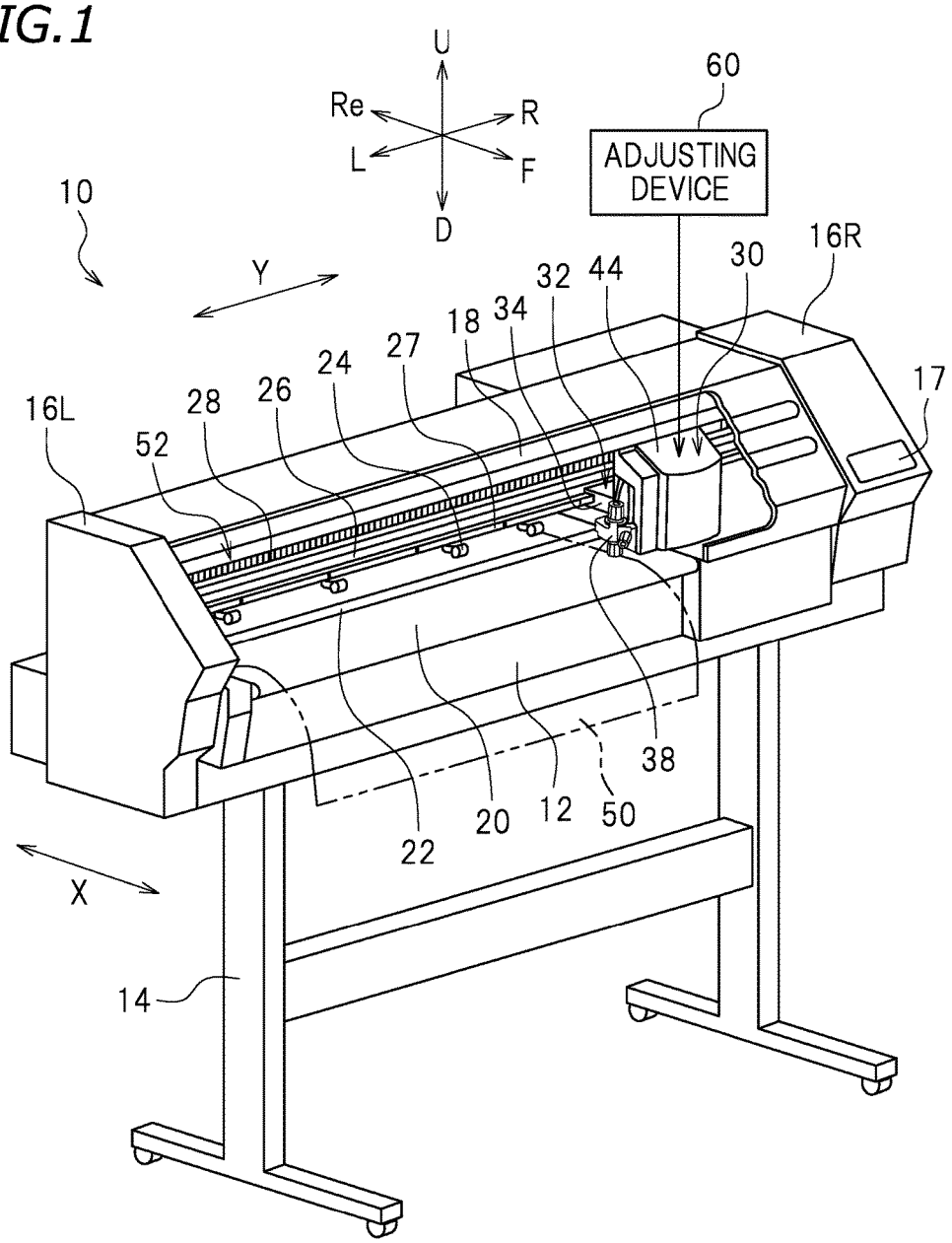
FIG. 1 is a perspective view illustrating a cutting apparatus.

Hereinbelow, preferred embodiments of the present invention will be described with reference to the drawings. As illustrated in FIG. 1, a cutting apparatus 10 according to the present preferred embodiment is an apparatus to cut a work material 50 such as paper or sheet material into a desired shape. It should be noted that the work material 50 is not limited to a sheet-shaped medium, but may be a plate-shaped material, such as a glass plate.

In the present description, the direction in which a later-described cutting head 30 moves is referred to as a "main scanning direction," as appropriate. Herein, the main scanning direction corresponds to a lateral direction (widthwise direction) of the work material 50. On the other hand, a direction perpendicular to the main scanning direction is referred to as a "sub-scanning direction," as appropriate. In the following description, the terms "left," "right," "up," and "down" respectively refer to left, right, up, and down as defined based on the perspective of the operator facing the cutting apparatus 10. A direction approaching toward the operator relative to the cutting apparatus 10 is defined as "frontward," and a direction moving away from the operator relative to the cutting apparatus 10 is defined as "rearward." Reference characters F, Re, L, R, U, and D in the drawings represent front, rear, left, right, up, and down, respectively. Reference character Y in the drawings represents the main scanning direction. In the present preferred embodiment, the main scanning direction is a lateral direction, i.e., a left-to-right/right-to-left direction. Reference character X in the drawings represents the sub-scanning direction. The sub-scanning direction X is a direction perpendicular to the main scanning direction Y. In the present preferred embodiment, the sub-scanning direction is a front-to-rear/rear-to-front direction. It should be noted, however, that these directional terms are merely provided for convenience in illustration and should not be construed as limiting.

As illustrated in FIG. 1, the cutting apparatus 10 includes a main body 12, a left side cover 16L, a right side cover 16R, a center wall 18, a platen 20, a grid roller 22, pinch rollers 24, a guide rail 26, a belt 28, and a cutting head 30.

The main body 12 is supported by a stand 14. The main body 12 extends in a main scanning direction Y. The left side cover 16L is provided at the left end of the main body 12. The right side cover 16R is provided at the right end of the main body 12. The main body 12 is provided with the center wall 18, which extends in a vertical direction. The center wall 18 extends in a main scanning direction Y. The center wall 18 connects the left side cover 16L and the right side cover 16R to each other. The right side cover 16R is provided with an operation panel 17. The operation panel 17 displays the status of the cutting apparatus 10 and the like. The operation panel 17 may be provided on the left side cover 16L.

The main body 12 is provided with the platen 20 to support a work material 50. The platen 20 is provided with a cylindrical grid roller 22. The grid roller 22 is buried in the platen 20 such that its upper surface portion is exposed. The grid roller 22 is driven by a feed motor 69 (see FIG. 5). The grid roller 22 is a feeding mechanism to move the work material 50 in a sub-scanning direction X. A plurality of pinch rollers 24 are disposed above the grid roller 22. The pinch rollers 24 are disposed so as to face the grid roller 22. The pinch rollers 24 are configured so that their vertical positions are able to be set depending on the thickness of the work material 50. The work material 50 is sandwiched between the pinch rollers 24 and the grid roller 22. The grid roller 22 and the pinch rollers 24 transfer the work material 50 in a sub-scanning direction X while holding the work material 50 therebetween.

The guide rail 26 is provided on the center wall 18. The guide rail 26 is disposed above the platen 20. The guide rail 26 is disposed parallel or substantially parallel to the platen 20. The guide rail 26 extends in a main scanning direction Y. The guide rail 26 includes an engaging portion 27 protruding frontward.

The belt 28 is disposed parallel or substantially parallel to a wall surface of the center wall 18. The belt 28 extends in a main scanning direction Y. The belt 28 is an endless belt. The belt 28 is wrapped around pulleys, not shown, provided at the right and left ends of the belt 28. One of the pulleys is connected to a carriage motor 66 (see FIG. 5) to drive the pulley. As the carriage motor 66 rotates, the pulley rotates accordingly, and the belt 28 travels in a main scanning direction Y. The rotation of the carriage motor 66 enables the carriage 32 to move relatively to the work material 50. The belt 28 and the guide rail 26 together define a moving mechanism 52.

Figure 2:
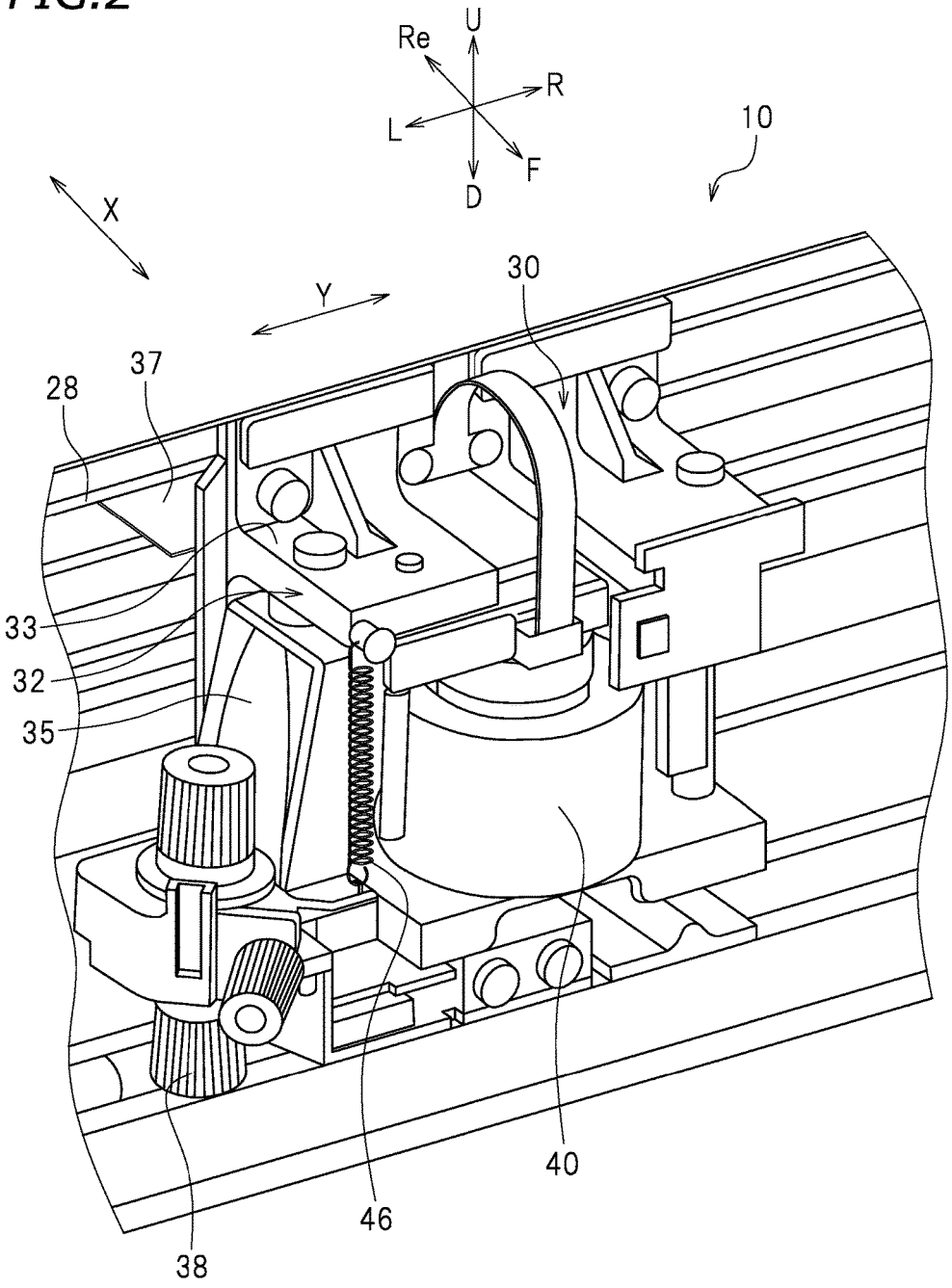
FIG. 2 is a perspective view illustrating the interior of the cutting apparatus.

The cutting head 30 is movable in a main scanning direction Y along the guide rail 26. The cutting head 30 cuts the work material 50. As illustrated in FIG. 2, the cutting head 30 includes a carriage 32, a cutter 38, a cylindrically-shaped voice coil motor 40, and a cover 44 (see FIG. 3).

The carriage 32 supports a later-described holder 35 and is movable relatively to the work material 50. The carriage 32 is fitted slidably to the guide rail 26 (see FIG. 1). The carriage 32 is secured to the belt 28. As the belt 28 travels, the carriage 32 moves in a main scanning direction Y along the guide rail 26. The carriage 32 moves the cutter 38 and the voice coil motor 40 in the main scanning direction Y. The carriage 32 is equipped with a carriage base 33 to support the cutter 38 and the voice coil motor 40. The carriage 32 includes a guide 34 (see FIG. 1) and a fastening plate 37. As illustrated in FIG. 1, the guide 34 engages with the engaging portion 27 of the guide rail 26. The guide 34 is slidable relatively to the guide rail 26. As illustrated in FIG. 2, the fastening plate 37 is secured to the belt 28. The guide 34 and the carriage base 33 are secured to each other by a bolt or the like. The carriage 32 is supported on the guide rail 26.

As illustrated in FIG. 2, the voice coil motor 40 is mounted to the carriage 32. The voice coil motor 40 is supported by the carriage base 33. The voice coil motor 40 is coupled to a holder 35, and it imparts a force to the holder 35 at least in a direction approaching toward the work material 50 (see FIG. 1). In the present preferred embodiment, the voice coil motor 40 imparts either an upward force or a downward force to the holder 35. The voice coil motor 40 is capable of changing the force to be imparted to the holder 35 according to a supply signal (i.e., a current signal) supplied to the voice coil motor 40. The voice coil motor 40 may be a known voice coil motor. The configuration of the voice coil motor 40 is well known, and therefore further description thereof is deemed unnecessary.

The cutter 38 is mounted to the carriage 32. The cutter 38 is retained by the holder 35, which is movable upward and downward. The holder 35 supports the cutter 38 so as to enable the cutter 38 to approach toward and move away from the work material 50 (see FIG. 1). The cutter 38 is disposed to the left of the holder 35. A spring 46 is provided between the holder 35 and the carriage base 33. The holder 35 receives an upward biasing force provided by the spring 46. The holder 35 is connected to the voice coil motor 40. The holder 35 moves upward upon receiving an upward force from the voice coil motor 40. The holder 35 moves downward upon receiving a downward force from the voice coil motor 40. As a result, the cutter 38, which is retained by the holder 35, also moves upward and downward by receiving a driving force of the voice coil motor 40.

Figure 3:
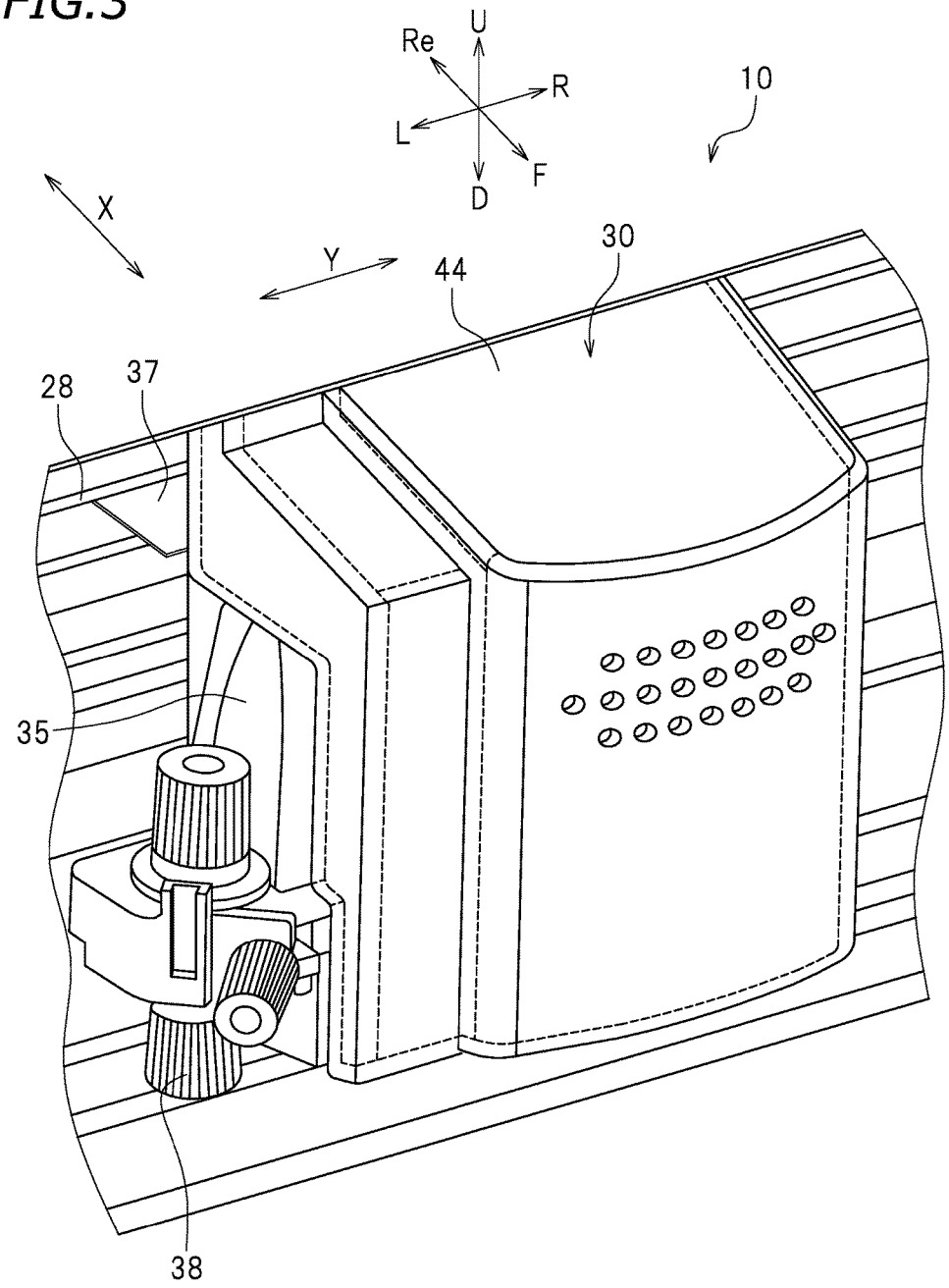
FIG. 3 is a perspective view illustrating the exterior of the cutting apparatus.

As illustrated in FIG. 1, the cover 44 is fitted to the carriage 32. As illustrated in FIG. 3, the cover 44 covers the cutting head 30, the carriage 32, the carriage base 33, the voice coil motor 40, and the spring 46. The cover 44 covers a portion of the holder 35. The cutter 38 is not covered by the cover 44. Providing such a cover 44 prevents cutting dust produced during cutting from entering the inside of the cover 44.

Figure 4:
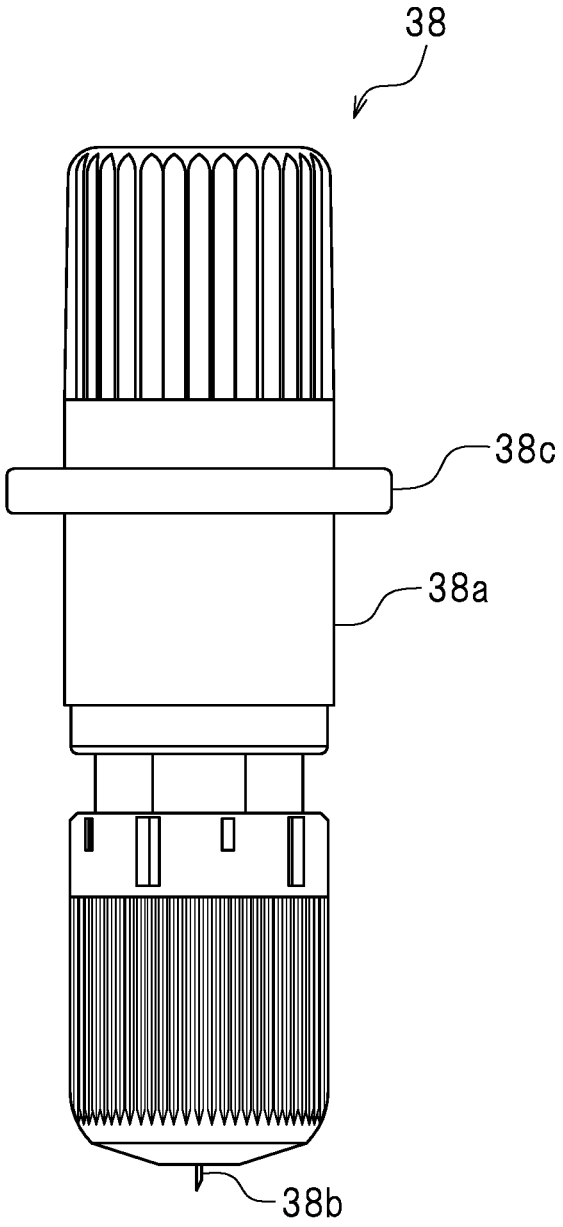
FIG. 4 is a front view illustrating a cutter.

As illustrated in FIG. 4, the cutter 38 includes a main body portion 38*a* extending in a rod shape and retained by the holder 35 (see FIG. 3), a blade 38*b* secured to a lower end of the main body portion 38*a*, and a flange portion 38*c* provided on the main body portion 38*a*. The work material 50 (see FIG. 1) is cut by the blade 38*b* of the cutter 38. As described previously, the cutter 38 is moved in the main scanning direction Y by the carriage 32. Accordingly, the blade 38*b* of the cutter 38 is moved in the main scanning direction Y.

As illustrated in FIG. 1, when cutting the work material 50 using the cutting apparatus 10, the vertical position of the blade 38*b* (see FIG. 4) of the cutter 38 is adjusted by the voice coil motor 40 (see FIG. 2). When the adjustment of the vertical position of the blade 38*b* has ended, the work material 50 is moved in the sub-scanning direction X by the grid roller 22 while moving the blade 38*b* in the main scanning direction Y by the carriage motor 66 (see FIG. 5). As a result, the work material 50 is cut into a predetermined shape.

Figure 5:
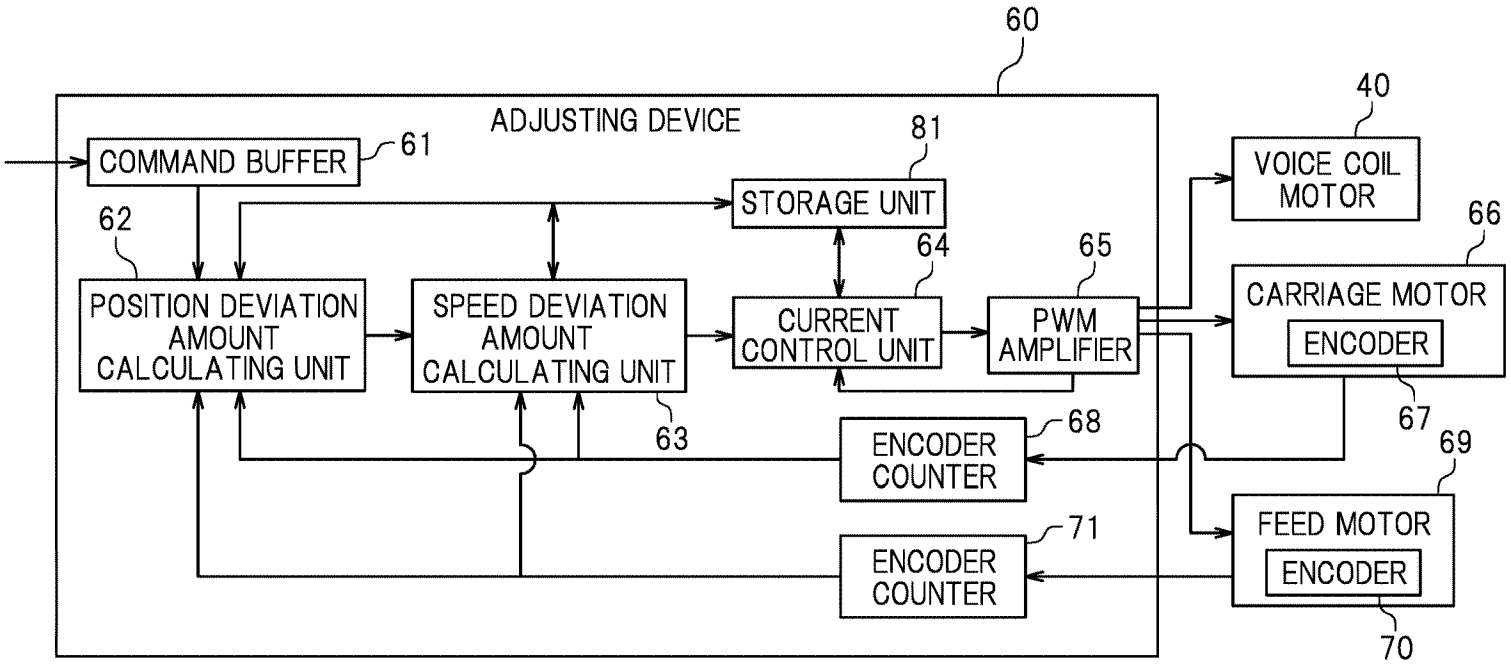
FIG. 5 is a block diagram illustrating a control system of the cutting apparatus.

Next, the control system of the cutting apparatus 10 will be described. As illustrated in FIG. 5, the cutting apparatus 10 includes an adjusting device 60. When the cutting pressure is inappropriate, the adjusting device 60 performs adjustment of cutting pressure CP (see FIGS. 11A and 11B) and adjustment of cutting speed CV (i.e., relative speed of the cutter 38) for the work material 50. The cutting pressure CP refers to a value indicating how much pressure is applied to the work material 50 by the cutter 38 to carry out cutting. The adjusting device 60 is disposed in the right side cover 16R. The adjusting device 60 may be disposed in the left side cover 16L. The adjusting device 60 includes, for example, electronic circuits, and includes a command buffer 61, a position deviation amount calculator 62, a speed deviation amount calculator 63, a current controller 64, a PWM amplifier 65, an encoder counter 68, an encoder counter 71, and a storage 81. The position deviation amount calculator 62, the speed deviation amount calculator 63, and the current controller 64 may include, for example, a single processor or a plurality of processors. The storage 81 may include a memory, such as a ROM.

The command buffer 61 receives the information of a target cutting speed and the information of a target position of the carriage 32 from a control device, which is not shown. The target cutting speed of the carriage 32 is a predetermined speed that has been determined in advance in the cutting apparatus 10, which is a relative speed of the carriage 32 relative to the work material 50. The target position of the carriage 32 is a predetermined position that is able to be calculated from the predetermined speed, which is a relative position of the carriage 32 relative to the work material 50.

The target cutting speed of the carriage 32 is classified into, for example, a target cutting speed at an initial stage of cutting, a target cutting speed after the initial stage of cutting, and a target cutting speed at an end stage of cutting. Although the details will be described later, the target cutting speed is set in the present preferred embodiment so that the target cutting speed increases at the initial stage of cutting, the target cutting speed is constant after the initial stage, and the target cutting speed decreases at the end stage of cutting. The operator can set the target cutting speed of the carriage 32 using the operation panel 17 (see FIG. 1) of the cutting apparatus 10. It should be noted that the above-mentioned target position is calculated from the target cutting speed that has been set. The command buffer 61 provides the information of the target cutting speed and the information of the target position of the carriage 32 to the position deviation amount calculator 62.

As illustrated in FIG. 5, the carriage motor 66 preferably includes an encoder 67. That is, the carriage motor 66 preferably is a servomotor. The encoder 67 is synchronized with rotation of the rotary shaft of the carriage motor 66, and it outputs a pulse signal at every predetermined rotation angle. The encoder 67 provides the pulse signal to an encoder counter 68. Likewise, the feed motor 69 preferably includes an encoder 70. That is, the feed motor 69 preferably is a servomotor. The encoder 70 is synchronized with rotation of the rotary shaft of the feed motor 69, and outputs a pulse signal at every predetermined rotation angle. The encoder 70 provides the pulse signal to an encoder counter 71. The method of generating pulse signals in the encoders 67 and 70 is well known, and therefore further description thereof is deemed unnecessary.

The encoder counter 68 counts the pulse signals provided from the encoder 67. The encoder counter 68 provides the information of the counted pulse signals to the position deviation amount calculator 62 and the speed deviation amount calculator 63. Likewise, the encoder counter 71 counts the pulse signals provided from the encoder 70. The encoder counter 71 provides the information of the counted pulse signals to the position deviation amount calculator 62 and the speed deviation amount calculator 63.

Figure 7A:
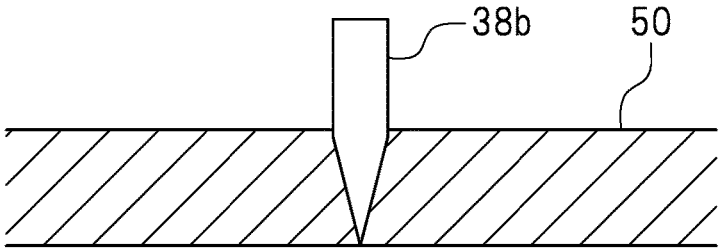
FIG. 7A is a view illustrating a portion of a work material that has been cut across its entire thickness.
Figure 7B:
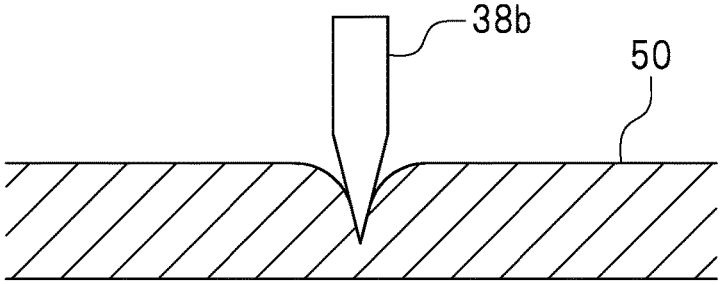
FIG. 7B is a view illustrating a portion of the work material that has not been cut entirely across its thickness.

The position deviation amount calculator 62 calculates the current position of the cutter 38 from the pulse signal supplied from the encoder counter 68 and the pulse signal supplied from the encoder counter 71. The current position of the cutter 38 is acquired while defining the initial position of the cutter 38 as zero (0). The position deviation amount calculator 62 calculates a position deviation amount IH (see FIGS. 8A and 8B), which is the difference between the current position and the target position of the carriage 32 provided from the command buffer 61. The position deviation amount calculator 62 calculates the position deviation amount IH by subtracting the current position from the target position. The position deviation amount IH can take either a positive value or a negative value. Thus, the position deviation amount calculator 62 calculates the deviation amount of the current position with respect to the target position of the carriage 32. For example, when the position deviation amount IH is a positive value (which means that the current position is less than the target position) and also that value is relatively large, it indicates that the cutting pressure CP on the work material 50 is insufficient. Here, when the cutting pressure CP is sufficient, the blade 38*b* of the cutter 38 is able to cut the work material 50 across its entire thickness, as illustrated in FIG. 7A, even though it receives a repulsive force from the work material 50 during cutting. On the other hand, when the cutting pressure CP is insufficient, the blade 38*b* of the cutter 38 cannot counter the repulsive force from the work material 50 during cutting, which results in cutting the work material 50 partially across its thickness, as illustrated in FIG. 7B. In addition, when the cutting pressure CP is insufficient, the cutter 38, which is supposed to reach the preset target position, may stop before the target position while being unable to fully cut the amount that is supposed to be cut. When the position deviation amount IH is near zero (0), it indicates that the cutting pressure CP is set almost at an appropriate value. When the position deviation amount IH is zero (0), it indicates that the cutting pressure CP is set at an appropriate value. The position deviation amount calculator 62 provides the information of the target cutting speed of the carriage 32, which is acquired from the command buffer 61, to the speed deviation amount calculator 63. It is also possible that the command buffer 61 may directly provide the information of the target cutting speed of the carriage 32 to the speed deviation amount calculator 63.

The speed deviation amount calculator 63 calculates the current cutting speed of the cutter 38 by calculating the current position of the cutter 38 from the pulse signal supplied from the encoder counter 68 and the pulse signal supplied from the encoder counter 71 and calculating the position information per unit time. The speed deviation amount calculator 63 calculates a speed deviation amount SH (see FIGS. 8A and 8B), which is the difference between the current cutting speed and the target cutting speed of the carriage 32. The speed deviation amount calculator 63 calculates the speed deviation amount SH by subtracting the current cutting speed from the target cutting speed. The speed deviation amount SH can take either a positive value or a negative value. Thus, the speed deviation amount calculator 63 calculates the deviation amount of the current cutting speed with respect to the target cutting speed of the carriage 32. For example, when the speed deviation amount SH is a positive value (which means that the current cutting speed is less than the target cutting speed) and also that value is relatively large, it indicates that the cutting pressure CP on the work material 50 is insufficient. As already described above, when the cutting pressure CP is insufficient, the cutter 38, which is supposed to reach the preset target position, may stop before the target position while being unable to fully cut the amount that is supposed to be cut. When the speed deviation amount SH is near zero (0), it indicates that the cutting pressure CP is set almost at an appropriate value. When the speed deviation amount SH is zero (0), it indicates that the cutting pressure CP is set at an appropriate value. However, when the cutting pressure CP is too high and set in excess, it is possible that the blade tip of the cutter 38 may cut through the work material 50 and then continue to be pressed further against the base, which is made of metal or the like and on which the work material 50 is to be placed, resulting in hindering movement of the cutter 38. Because such a condition is out of bounds of the normal cutting operation, it should be regarded as out of consideration herein. The speed deviation amount calculator 63 provides the information of the calculated speed deviation amount SH to the current controller 64.

Next, the current controller 64 adjusts the current value that is supplied to the voice coil motor 40 via the PWM amplifier 65 according to the speed deviation amount SH acquired from the speed deviation amount calculator 63. Increasing the supply current to the voice coil motor 40 increases the driving force generated by the voice coil motor 40, and raises the cutting pressure CP of the cutter 38 accordingly. Decreasing the supply current to the voice coil motor 40 decreases the driving force generated by the voice coil motor 40, and accordingly lowers the cutting pressure CP of the cutter 38. The details will be described later. The current controller 64 preferably includes a publicly known interface circuit, such as a current loop circuit. Based on the difference between a target current value and a signal that is fed back to the current controller 64, the PWM amplifier 65 modulates the signal.

The storage 81 stores in advance a relationship between the load amount of the carriage motor 66 and the supply signal amount to the voice coil motor 40, in other words, a later-described relationship between the speed deviation amount SH and the cutting pressure CP value (i.e., the first relationship), shown in FIG. 11A. The storage 81 also stores in advance a relationship between the load amount of the carriage motor 66 and the supply signal amount to the carriage motor 66, in other words, a later-described relationship between the speed deviation amount SH and the cutting speed value for the work material 50 (i.e., the second relationship), shown in FIG. 11B.

In the present preferred embodiment, first, the test cutting is performed prior to the actual cutting of the work material in order to acquire and store the above-mentioned first relationship and the above-mentioned second relationship. Then, an appropriate cutting pressure is automatically set based on the above-mentioned first relationship and the speed deviation amount SH acquired at the time of actual cutting, and an appropriate cutting speed for the work material 50 is automatically set based on the above-mentioned second relationship and the speed deviation amount SH acquired at the time of actual cutting. Hereinbelow, the details are described.

Figure 6:
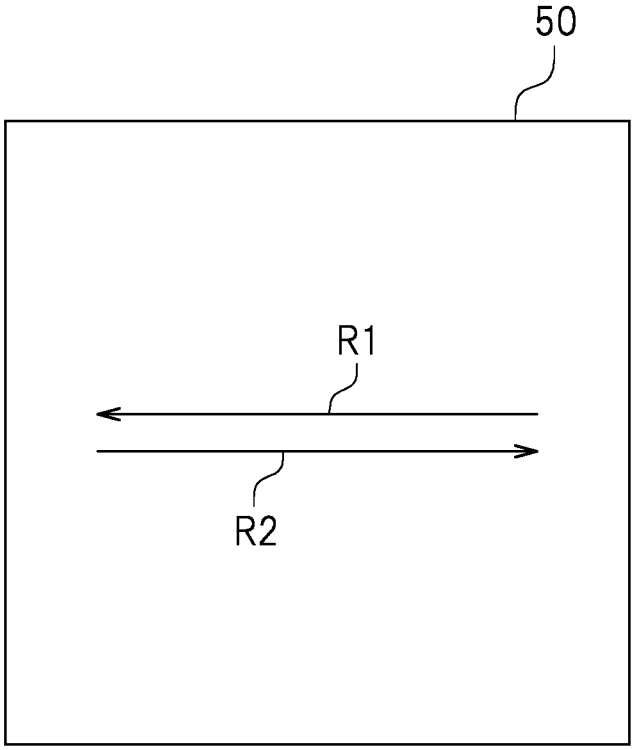
FIG. 6 is a view illustrating an outward route and a return route of the cutter.

As illustrated in FIG. 6, a speed deviation amount SH and a position deviation amount IH were obtained while cutting a work material 50 along an outward path R1 and thereafter cutting the work material 50 along a return path R2. When cutting the work material 50 along the outward path R1, the cutter 38 was moved leftward by the carriage 32 while the delivery of the work material 50 by the grid roller 22 was stopped. When cutting the work material 50 along the return path R2, the cutter 38 was moved rightward by the carriage 32 while the delivery of the work material 50 by the grid roller 22 was stopped. A thin vinyl chloride sheet and a thick sandblasted rubber sheet were used as the work material 50 for the test cutting. Each distance of the outward path R1 and the return path R2 is about 50 cm, for example.

Figure 8A:
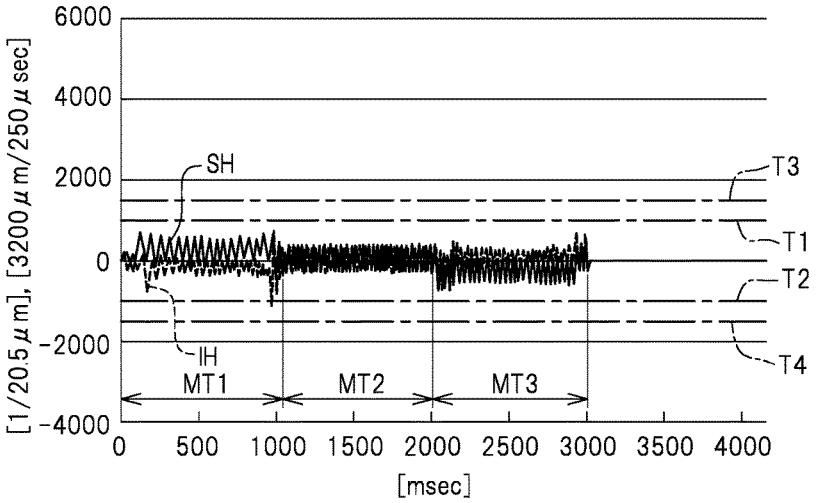
FIG. 8A is a graph showing respective changes over time of a speed deviation amount and a position deviation amount when a vinyl chloride sheet is cut by the cutting apparatus.
Figure 8B:
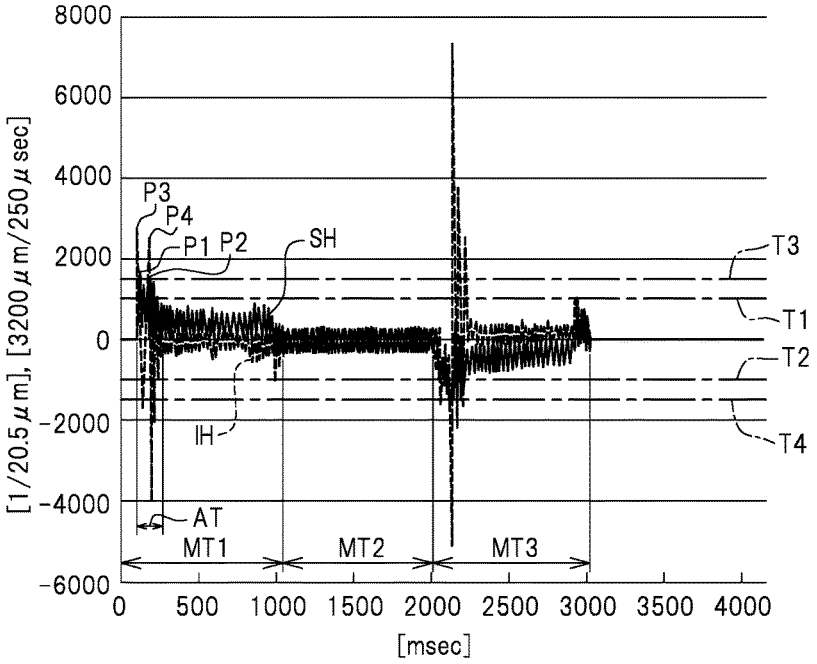
FIG. 8B is a graph showing respective changes over time of a speed deviation amount and a position deviation amount when a sandblasted rubber sheet is cut by the cutting apparatus.

FIG. 8A is a graph showing respective changes over time of the speed deviation amount SH and the position deviation amount IH when the thin vinyl chloride sheet was cut by the cutting apparatus 10. FIG. 8B is a graph showing respective changes over time of the speed deviation amount SH and the position deviation amount IH when the sandblasted rubber sheet was cut by the cutting apparatus 10. In each of the graphs of FIGS. 8A and 8B, the horizontal axis represents time (msec) and the vertical axis represents position deviation amount IH (about 1/20.5 μm) and speed deviation amount SH (about 3200 μm/250 μsec), for example. Note that the data shown in FIG. 8A are collective data of the data that are obtained when cutting the vinyl chloride sheet along the outward path R1 as shown in FIG. 6 and the data that are obtained when cutting the vinyl chloride sheet along the return path R2 as shown in FIG. 6. The data shown in FIG. 8B are collective data of the data that are obtained when cutting the sandblasted rubber sheet along the outgoing path R1 as shown in FIG. 6 and the data that are obtained when cutting the sandblasted rubber sheet along the return path R2 as shown in FIG. 6. In each of FIGS. 8A and 8B, the time period during which the cutting is made along the outward path R1 shown in FIG. 6 is indicated as MT1, the time period during which the cutting is stopped is indicated as MT2, and the time period during which the cutting is made along the return path R2 is indicated as MT3.

As shown in FIG. 8A, for the thin work material 50, no significant changes were observed in the speed deviation amount SH and the position deviation amount IH during cutting from the start to the end. In contrast, for the thick work material 50, peaks P1 and P2 outside a threshold value T1 were observed in the speed deviation amount SH, and peaks P3 and P4 outside a threshold value T3 were observed in the position deviation amount IH, as shown in FIG. 8B. This makes it possible to estimate that the cutting pressure CP for the thick work material 50 is inappropriate. In FIGS. 8A and 8B, the speed deviation amount SH takes a positive value when the current cutting speed of the cutter 38 (see FIG. 1) does not reach the target cutting speed, while it takes a negative value when the current cutting speed exceeds the target cutting speed. Also, the position deviation amount IH takes a positive value when the current position of the cutter 38 does not reach the target position, while it takes a negative value when the current position is beyond the target position. In each of FIGS. 8A and 8B, the threshold value of the speed deviation amount SH that is a negative value is shown as a threshold value T2, and the threshold value of the position deviation amount IH that is a negative value is shown as a threshold value T4. It should be noted that the threshold values T1, T2, T3, and T4 are set by the operator in advance and stored in the storage 81 (see FIG. 5).

Figure 9A:
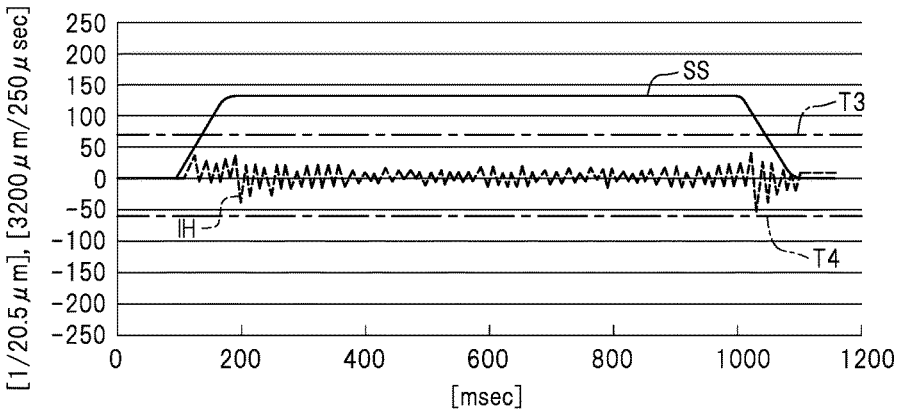
FIG. 9A is a graph showing changes over time of a position deviation amount when a vinyl chloride sheet is cut along an outward path shown in FIG. 6.
Figure 9B:
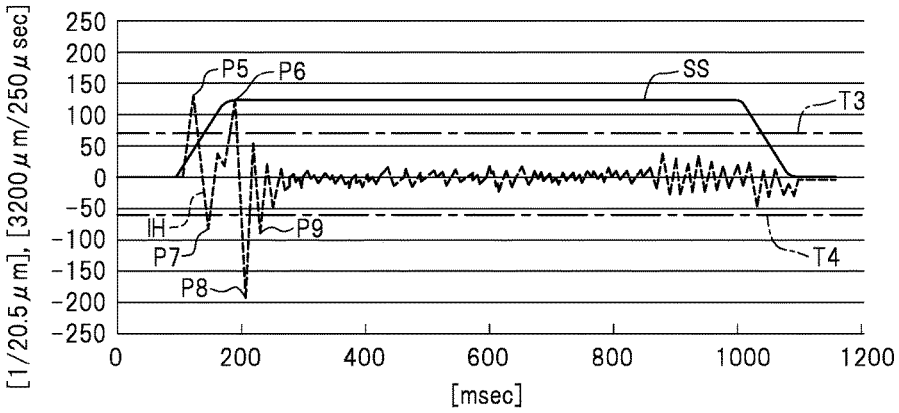
FIG. 9B is a graph showing changes over time of a position deviation amount when a sandblasted rubber sheet is cut along the outward path shown in FIG. 6.

Here, the tendency of the position deviation amount IH will be described below. FIG. 9A is a graph showing changes over time of the position deviation amount IH when a thin vinyl chloride sheet is cut along an outgoing path R1 shown in FIG. 6. FIG. 9B is a graph showing changes over time of the position deviation amount IH when a thick sandblasted rubber sheet is cut along the outgoing path R1 shown in FIG. 6. In each of FIGS. 9A and 9B, the graph line SS represents the changes over time of the target cutting speed. For the thin vinyl chloride sheet, no significant change in the position deviation amount IH was observed from the start of cutting to the end of cutting, as shown in FIG. 9A. In contrast, for the thick work material 50, peaks P5 and P6 outside the threshold value T3 were observed in the position deviation amount IH, and peaks P7, P8, and P9 outside the threshold value T4 were also observed, as shown in FIG. 9B. In particular, a plurality of large peaks were observed during an acceleration period AT, in which the cutting speed is accelerated. After the acceleration period AT, the amplitude of the position deviation amount IH was attenuated.

Figure 10A:
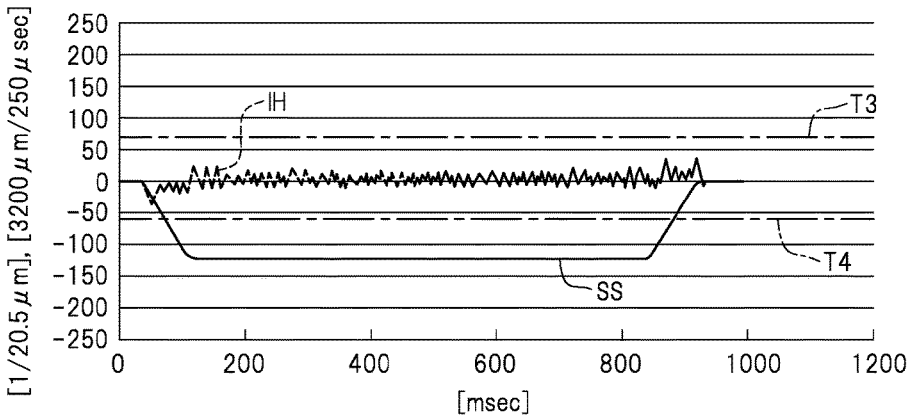
FIG. 10A is a graph showing changes over time of a position deviation amount when a vinyl chloride sheet is cut along a return path shown in FIG. 6.
Figure 10B:
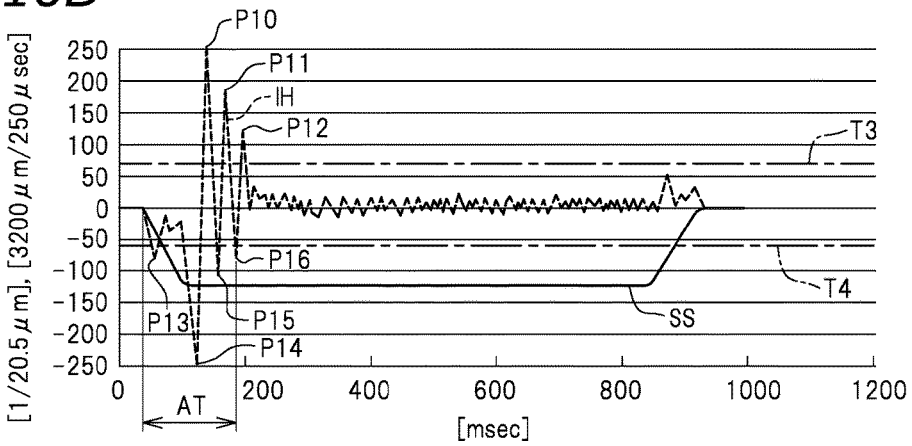
FIG. 10B is a graph showing changes over time of a position deviation amount when a sandblasted rubber sheet is cut along the return path shown in FIG. 6.

FIG. 10A is a graph showing changes over time of the position deviation amount IH when a thin vinyl chloride sheet is cut along the return path R2 shown in FIG. 6. FIG. 10B is a graph showing changes over time of the position deviation amount IH when a thick sandblasted rubber sheet is cut along the return path R2 shown in FIG. 6. In each of FIGS. 10A and 10B, the graph line SS represents the changes over time of the target cutting speed of the carriage 32. For the thin vinyl chloride sheet, no significant change in the position deviation amount IH was observed from the start of cutting to the end of cutting, as shown in FIG. 10A. In contrast, for the thick sandblasted rubber sheet, peaks P10, P11, and P12 outside the threshold value T3 were observed in the position deviation amount IH, and peaks P13, P14, P15, and P16 outside the threshold value T4 were also observed, as shown in FIG. 10B. As in the case of FIG. 9B, a plurality of large peaks were observed particularly during the acceleration period AT of the carriage 32. After the acceleration period AT, the amplitude of the position deviation amount IH was attenuated.

Figure 11A:
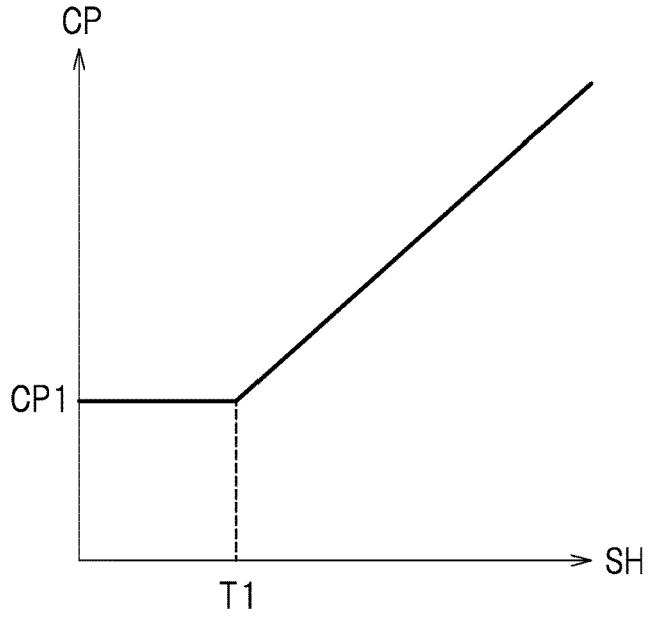
FIG. 11A is a graph showing the cutting pressure according to speed deviation amount.
Figure 11B:
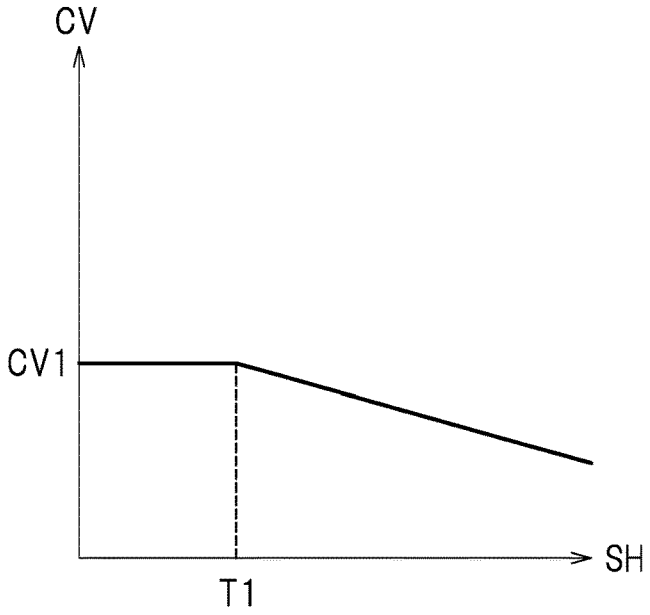
FIG. 11B is a graph showing the cutting speed according to a speed deviation amount.

FIG. 11A is a graph showing the cutting pressure CP according to the speed deviation amount SH, and FIG. 11B is a graph showing the cutting speed CV according to speed deviation amount SH. As illustrated in FIG. 11A, when the speed deviation amount SH is equal to or less than the threshold value T1, it is judged that the cutting pressure CP is set at an appropriate cutting pressure CP1 for the work material 50. When the speed deviation amount SH is a positive value greater than the threshold value T1, the cutting pressure CP is increased linearly. When the speed deviation amount SH is a positive value greater than the threshold value T1, the current controller 64 (see FIG. 5) determines a cutting pressure CP from the data of FIG. 11A, according to the value of the speed deviation amount SH. Then, an appropriate cutting pressure CP is able to be obtained by, for example, applying the maximum peak value of the speed deviation amount SH obtained during the acceleration period AT (see FIG. 8B) to the data of FIG. 11A. The resulting appropriate cutting pressure CP should be used at the time of actual cutting for the work material 50. This achieves a preset function. The current controller 64 adjusts the current value that is supplied to the voice coil motor 40 so that the appropriate cutting pressure CP is obtained. The data of FIG. 11A are produced by the speed deviation amount calculator 63 after the test cutting for the work material 50 and stored in the storage 81. The data of FIG. 11A that represent the relationship between the speed deviation amount SH and the cutting pressure CP correspond to the first relationship. It should be noted that the adjustment of the cutting pressure CP is able to be performed in a similar manner also when the speed deviation amount SH is a negative value.

The current controller 64 (see FIG. 5) may reduce the cutting speed CV, in addition to the process of adjusting the cutting pressure CP according to the value of the speed deviation amount SH when the speed deviation amount SH is a positive value greater than the threshold value T1 as described above, or without performing the process of adjusting the cutting pressure CP. When only the cutting speed CV is adjusted without adjusting the cutting pressure CP, only the second relationship should be acquired and stored without acquiring the first relationship. As illustrated in FIG. 11B, when the speed deviation amount SH is equal to or less than the threshold value T1, it is judged that the cutting speed CV is set at an appropriate cutting speed CV1. When the speed deviation amount SH is greater than the threshold value T1, the cutting speed CV is reduced linearly. When the speed deviation amount SH is greater than the threshold value T1, the current controller 64 determines a cutting speed CV from the data of FIG. 11B, according to the value of the speed deviation amount SH. Then, an appropriate cutting speed CV is able to be obtained by, for example, applying the maximum peak value of the speed deviation amount SH obtained during the acceleration period AT (see FIG. 8B) to the data of FIG. 11B. The resulting appropriate cutting speed CV should be used at the time of actual cutting for the work material 50. As a result, this achieves a preset function. The current controller 64 controls the rotation action of the carriage motor 66 so that the cutting speed CV becomes an appropriate speed. The data of FIG. 11B are produced by the speed deviation amount calculator 63 after the test cutting for the work material 50 and stored in the storage 81. The data of FIG. 11B that represent the relationship between the speed deviation amount SH and the cutting speed CV correspond to the second relationship. It should be noted that the adjustment of the cutting speed CV is able to be performed in a similar manner also when the speed deviation amount SH is a negative value. As in the case of the data of FIG. 11B that represent the relationship between the speed deviation amount SH and the cutting speed CV, the data that represent the relationship between the speed deviation amount SH and the rotational speed of the grid roller 22 are produced after the test cutting, and stored in the storage 81.

As thus far described, the cutting apparatus 10 according to the present preferred embodiment makes it possible to supply an appropriate supply signal to the voice coil motor 40 based on the above-described first relationship and the speed deviation amount SH of the carriage motor 66 detected by the speed deviation amount detector 63. Thus, the cutting pressure CP of the cutter 38 is able to be adjusted appropriately. This enables the cutting apparatus 10 to cut the work material 50 at one time. Therefore, it becomes unnecessary to carry out the two-times cutting operation or the three-times cutting operation. As a result, troublesome work of the operator is significantly reduced, and work efficiency is significantly improved.

Moreover, with the present preferred embodiment, the cutting pressure CP is able to be increased as the speed deviation amount SH increases. This prevents the cutting pressure CP to be set from being in an inappropriate state and makes it possible to cut the work material 50 at one time.

Furthermore, in the present preferred embodiment, when the speed deviation amount SH is equal to or less than the threshold value T1, the cutting pressure CP is able to be judged to be appropriate. On the other hand, when the speed deviation amount SH is greater than the threshold value T1, the cutting pressure CP is increased to reduce the load caused by cutting, so that the load is able to be set in an appropriate state.

The cutting apparatus 10 according to the present preferred embodiment makes it possible to supply an appropriate supply signal to the carriage motor 66 based on the above-described second relationship and the speed deviation amount SH of the carriage motor 66 detected by the speed deviation amount detector 63. Thus, the cutting speed CV for the work material 50 is able to be adjusted appropriately. Thus, it becomes possible to cut the work material 50 reliably at one time. And also it becomes unnecessary to carry out the two-times cutting operation or the three-times cutting operation. As a result, troublesome work of the operator is significantly reduced, and work efficiency is able to be improved.

Thus, with the present preferred embodiment, the cutting speed CV for the work material 50 is able to be reduced as the speed deviation amount SH increases. This enables the carriage 32 to move at a low speed relatively to the work material 50 so as to cut the work material 50 reliably at one time.

Furthermore, according to the present preferred embodiment, the cutting speed CV for the work material 50 may be considered to be appropriate when the speed deviation amount SH is equal to or less than the threshold value T1. On the other hand, when the speed deviation amount SH is greater than the threshold value T1, the cutting speed CV for the work material 50 is able to be reduced by decreasing the value of the supply signal to the carriage motor 66. This enables the cutting apparatus 10 to cut the work material 50 at one time.

In addition, the present preferred embodiment makes it possible to calculate the speed deviation amount SH, which is the deviation amount of the current cutting speed from the target cutting speed, without making complicated calculations. Such a speed deviation amount SH is able to be used as the load information of the carriage motor 66.

The speed deviation amount and the position deviation amount tend to change greatly during acceleration. The present preferred embodiment prevents erroneous detection by using the speed deviation amount SH obtained during acceleration, so that the cutting pressure CP and the cutting speed for the work material 50 are able to be adjusted with high precision.

Furthermore, the present preferred embodiment makes it possible to adjust the movement of the carriage 32 relative to the work material 50 by controlling the rotation action of the carriage motor 66 and the rotation action of the feed motor 69.

Hereinabove, one preferred embodiment of the present invention has been described. It should be noted, however, that the foregoing preferred embodiment is merely exemplary, and the present invention may be embodied in various other forms of preferred embodiments, as described below.

In the foregoing preferred embodiment, the cutting pressure CP and the cutting speed CV for the work material 50 preferably are adjusted according to the speed deviation amount SH. However, this is merely illustrative. As will be described below, it is also possible to adjust the cutting pressure CP and the cutting speed CV according to the position deviation amount IH calculated by the position deviation amount calculator 62. In that case, it is also possible that the position deviation amount calculator 62 may provide the information of the position deviation amount IH to the current controller 64, and the current controller 64 may control the rotation action of each of the motors according to the position deviation amount IH. Thus, it is possible to use the position deviation amount IH, which is able to be calculated as a deviation amount of the current position from the target position of the carriage 32, as the load information of the carriage motor 66.

Figure 12A:
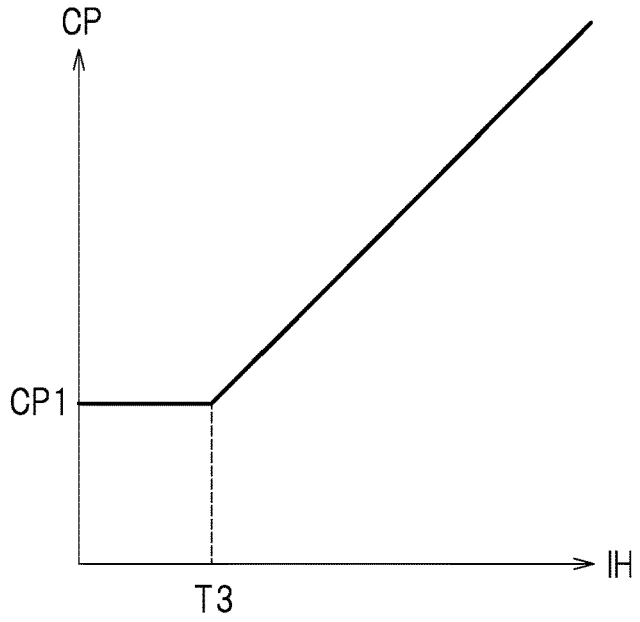
FIG. 12A is a graph showing the cutting pressure according to a position deviation amount.
Figure 12B:
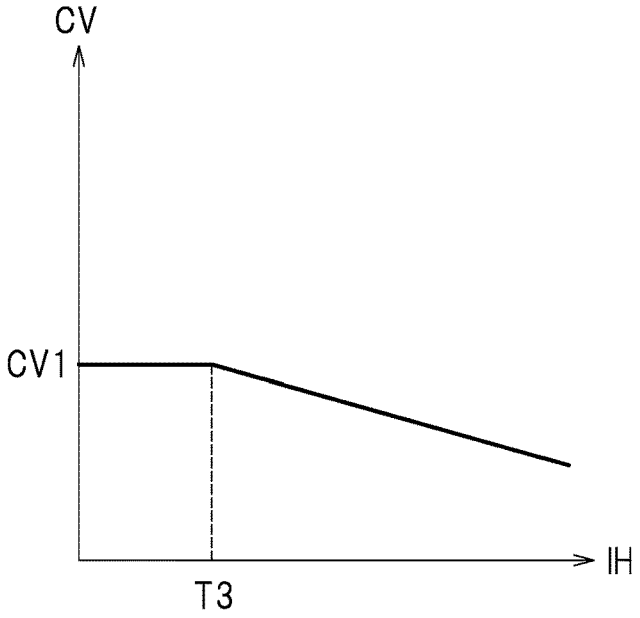
FIG. 12B is a graph showing the cutting speed according to a position deviation amount.

FIG. 12A is a graph showing the cutting pressure CP according to position deviation amount IH, and FIG. 12B is a graph showing the cutting speed CV according to position deviation amount IH. As illustrated in FIG. 12A, when the position deviation amount IH is equal to or less than the threshold value T3, it is judged that the cutting pressure CP is set at an appropriate cutting pressure CP1 for the work material 50. When the position deviation amount IH is a positive value greater than the threshold value T3, the cutting pressure CP is increased linearly. When the position deviation amount IH is a positive value greater than the threshold value T3, the current controller 64 (see FIG. 5) determines a cutting pressure CP from the data of FIG. 12A, according to the value of the position deviation amount IH.

Then, an appropriate cutting pressure CP is able to be obtained by applying the maximum peak value of the position deviation amount IH obtained during the acceleration period AT to the data of FIG. 12A. The resulting appropriate cutting pressure CP should be used at the time of actual cutting for the work material 50. The current controller 64 adjusts the current value that is supplied to the voice coil motor 40 so that the appropriate cutting pressure CP is able to be obtained. The data of FIG. 12A are produced by the position deviation amount calculator 62 after the test cutting for the work material 50 and stored in the storage 81.

The current controller 64 (see FIG. 5) may reduce the cutting speed CV, in addition to the process of adjusting the cutting pressure CP according to the value of the position deviation amount IH when the position deviation amount IH is a positive value greater than the threshold value T3 as described above, or without performing the process of adjusting the cutting pressure CP. As illustrated in FIG. 12B, when the position deviation amount IH is equal to or less than the threshold value T3, it is judged that the cutting speed CV is set at an appropriate cutting speed CV1. When the position deviation amount IH is greater than the threshold value T3, the cutting speed CV is reduced linearly. When the position deviation amount IH is greater than the threshold value T3, the current controller 64 determines a cutting speed CV from the data of FIG. 12B, according to the value of the position deviation amount IH. Then, an appropriate cutting speed CV is able to be obtained by applying the maximum peak value of the position deviation amount IH obtained during the acceleration period AT to the data of FIG. 12B. The obtained appropriate cutting speed CV should be used at the time of actual cutting for the work material 50. The current controller 64 controls the rotation action of the carriage motor 66 so that the cutting speed CV becomes an appropriate speed. The data of FIG. 12B are produced by the position deviation amount calculator 62 after the test cutting for the work material 50 and stored in the storage 81.

Although the present preferred embodiment and another present preferred embodiment have been described above, still other modifications can be made, as will be described below.

In the foregoing preferred embodiments, when the position deviation amount IH is large, it is judged that the cutting pressure CP is insufficient, and the cutting pressure CP is increased, for example. However, this is merely illustrative. The cutting pressure CP may be controlled so that the cutting pressure CP is reduced when the position deviation amount IH is large. Such a control operation is advantageous when, for example, cutting a work material 50 that has a high hardness and a certain thickness (for example, a thickness of about 5 mm) such that the work material 50 is impossible to cut at one time, because, in such a case, it is possible that the blade tip of the cutter 38 may not sufficiently cut into the work material 50.

In the foregoing preferred embodiments, the cutting pressure CP or the cutting speed CV preferably is adjusted according to the speed deviation amount SH or the position deviation amount IH. However, this is merely illustrative. It is also possible to carry out the two-times cutting operation or the like. More specifically, it is possible to cut the work material 50 to half the thickness thereof in the first cutting process, and then cut the remaining half-thickness portion of the work material 50 in the second cutting process.

In the foregoing preferred embodiments, the cutting pressure CP or the cutting speed CV is adjusted when the speed deviation amount SH is greater than the threshold value T1. However, this is merely illustrative. It is also possible that, in the case where a portion of the work material 50 that extends from the starting point of cutting to the end point of cutting needs to be cut, the work material 50 may be cut to a portion beyond the endpoint of cutting based on the speed deviation amount SH and the above-described second relationship when the speed deviation amount SH is greater than the threshold value T1. This prevents the occurrence of incomplete cutting.

In the foregoing preferred embodiments, the cutting speed CV is reduced according to the value of the speed deviation amount SH when the speed deviation amount SH is greater than the threshold value T1. However, this is merely illustrative. It is also possible to increase the cutting speed CV to bring the cutting speed CV closer to the target cutting speed when the speed deviation amount SH is greater than the threshold value T1. Increasing the cutting speed CV is able to, for example, increase the driving force to enable the cutter 38 to cut the work material 50 in a cutting direction. Depending on the material, hardness, and thickness of the work material 50, increasing the cutting speed CV is able to yield desirable cutting results.

In the foregoing preferred embodiments, a thick work material 50 and a thin work material 50 are prepared to acquire the speed deviation amount SH and the position deviation amount IH. However, this is merely illustrative. It is also possible that the speed deviation amount SH and the position deviation amount IH may be acquired based on the hardness of the work material 50.

In the foregoing preferred embodiments, the current controller 64 supplies a current signal as the supply signal to the voice coil motor 40. However, this is merely illustrative. The current controller 64 may supply a voltage signal as the supply signal.

In the foregoing preferred embodiments, the configuration of moving the cutter 38 relative to the work material 50 is achieved by moving the work material 50 in a front-to-rear/rear-to-front direction by the grid roller 22 and moving the cutter 38 in a left-to-right/right-to-left direction by the carriage 32. However, this is merely illustrative. It is also possible to use a configuration such that the cutter 38 is moved by the carriage 32 in the front-to-rear/rear-to-front direction and the work material 50 is moved by the grid roller 22 in the left-to-right/right-to-left direction.

In the foregoing preferred embodiments, the cutting apparatus 10 preferably is an apparatus that performs only the cutting of a work material 50. The cutting apparatus 10 according to a preferred embodiment of the present invention may, however, be equipped with other functions in addition to the cutting of the work material 50. For example, the cutting apparatus 10 may be what is called a cutting printer, which includes an ink head in addition to the cutting head 30 and performs printing and cutting of a work material such as a paper sheet.

A preferred embodiment of the present invention provides a non-transitory computer readable medium including a computer program that causes a computer to function as the above-described position deviation amount calculator 62 and the above-described speed deviation amount calculator 63. In a preferred embodiment of the present invention, the non-transitory computer readable medium in which the computer program is stored may include compact discs (CDs) and digital versatile disc (DVDs).

The terms and expressions which have been used herein are used as terms of description and not of limitation. There is no intention in the use of such terms and expressions of excluding any equivalents of any of the features shown or described, or portions thereof, and it is recognized that various modifications are possible within the scope of the present invention claimed. The present invention may be embodied in many different forms. This disclosure should be considered as providing exemplary preferred embodiments of the principles of the present invention. These preferred embodiments are described herein with the understanding that such preferred embodiments are not intended to limit the present invention to any specific preferred embodiments described and/or illustrated herein. The present invention is not limited to specific preferred embodiments described herein. The present invention encompasses all the preferred embodiments including equivalents, alterations, omissions, combinations, improvements, and/or modifications that can be recognized by those skilled in the arts based on this disclosure. Limitations in the claims should be interpreted broadly based on the language used in the claims, and such limitations should not be limited to specific preferred embodiments described in the present description or provided during prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A cutting apparatus comprising:
a cutter to cut a work material;
a holder to support the cutter so as to enable the cutter to approach toward and move away from the work material;
a carriage to support the holder and being movable relatively to the work material;
a first motor coupled to the carriage to cause the carriage to move relatively to the work material;
a second motor coupled to the holder to impart a force to the holder at least toward the work material; and
a controller configured or programmed to control the first motor and the second motor; wherein
the second motor is capable of changing the force to be imparted to the holder according to a supply signal supplied to the second motor; and
the controller is configured or programmed to include:
a load detector to detect a load of the first motor;
a storage to store a first relationship that is a predetermined relationship between the load of the first motor and the supply signal to the second motor; and
a cutting pressure controller configured or programmed to control a cutting pressure applied from the cutter to the work material by supplying the supply signal to the second motor based on the load of the first motor detected by the load detector and the first relationship stored in the storage.

2. The cutting apparatus according to claim 1, wherein the supply signal of the first relationship is set so that the work material receives a first cutting pressure from the cutter when the load of the first motor is at a first load, and so that the work material receives a second cutting pressure higher than the first pressure when the load of the first motor is at a second load greater than the first load.

3. The cutting apparatus according to claim 1, wherein the supply signal of the first relationship is set so that the cutting pressure applied from the cutter to the work material is constant when the load of the first motor is equal to or less than a first threshold value, and so that the cutting pressure increases as the load of the first motor increases when the load of the first motor is greater than the first threshold value.

4. The cutting apparatus according to claim 1, wherein:
the first motor includes a rotary shaft; and
the cutting apparatus further comprises:
an encoder synchronized with rotation of the rotary shaft of the first motor to output a pulse signal at each of at least one predetermined rotation angle; and
an encoder counter to count the pulse signal from the encoder; wherein
the load detector calculates a cutting speed of the carriage relative to the work material from the pulse signal counted by the encoder counter and calculates, as the load of the first motor, a speed deviation amount that is a difference between the cutting speed of the carriage and a target cutting speed of the carriage.

5. The cutting apparatus according to claim 4, wherein:
the controller is configured or programmed to move the carriage relatively to the work material while accelerating the carriage at an initial stage of cutting; and
the load detector calculates, as the load of the first motor, the speed deviation amount during the accelerating.

6. The cutting apparatus according to claim 1, wherein
the first motor includes a rotary shaft; and
the cutting apparatus further comprises:
an encoder synchronized with rotation of the rotary shaft of the first motor to output a pulse signal at each of at least one predetermined rotation angle; and
an encoder counter to count the pulse signal from the encoder; wherein
the load detector calculates a position of the carriage relative to the work material from the pulse signal counted by the encoder counter and calculates, as the load of the first motor, a position deviation amount that is a difference between the position of the carriage and a target position of the carriage.

7. The cutting apparatus according to claim 6, wherein:
the controller is configured or programmed to move the carriage relatively to the work material while accelerating the carriage at an initial stage of cutting; and
the load detector calculates, as the load of the first motor, the position deviation amount during the accelerating.

8. The cutting apparatus according to claim 1, further comprising:
a carriage motor to move the carriage in a first direction;
a grid roller to transfer the work material in a second direction that is perpendicular or substantially perpendicular to the first direction; and
a feed motor to rotate the grid roller; wherein
the first motor is the carriage motor or the feed motor.

9. A cutting apparatus comprising:
a cutter to cut a work material;
a holder to support the cutter so as to enable the cutter to approach toward and move away from the work material;
a carriage to support the holder and being movable relatively to the work material;
a first motor coupled to the carriage to cause the carriage to move relatively to the work material;
a second motor coupled to the holder to impart a force to the holder at least in a direction approaching toward the work material; and
a controller configured or programmed control the first motor and the second motor; wherein
the second motor is capable of changing the force to be imparted to the holder according to a supply signal supplied to the second motor; and
the controller is configured or programmed to include:
a load detector to detect a load of the first motor;

a storage to store a second relationship that is a predetermined relationship between the load of the first motor and the supply signal to the first motor; and a cutting speed controller configured or programmed to control a cutting speed for the work material by supplying the supply signal to the first motor based on the load of the first motor detected by the load detector and the second relationship stored in the storage.

10. The cutting apparatus according to claim 9, wherein the supply signal of the second relationship is set so that the cutting speed for the work material becomes a first cutting speed when the load of the first motor is at a first load, and that the cutting speed for the work material becomes a second speed lower than the first speed when the load of the first motor is at a second load greater than the first load.

11. The cutting apparatus according to claim 9, wherein the supply signal of the second relationship is set so that the cutting speed for the work material is constant when the load of the first motor is equal to or less than a second threshold value, and so that the cutting speed reduces as the load of the first motor increases when the load of the first motor is greater than the second threshold value.

12. The cutting apparatus according to claim 9, wherein:

the first motor includes a rotary shaft;

the cutting apparatus further comprises:

an encoder synchronized with rotation of the rotary shaft of the first motor to output a pulse signal at each of at least one predetermined rotation angle; and an encoder counter to count the pulse signal from the encoder; wherein the load detector calculates a cutting speed of the carriage relative to the work material from the pulse signal counted by the encoder counter and calculates, as the load of the first motor, a speed deviation amount that is a difference between the cutting speed of the carriage and a target cutting speed of the carriage.

13. The cutting apparatus according to claim 12, wherein the controller is configured or programmed to move the carriage relatively to the work material while accelerating the carriage at an initial stage of cutting; and the load detector calculates, as the load of the first motor, the speed deviation amount during the accelerating.

14. The cutting apparatus according to claim 9, wherein the first motor includes a rotary shaft; and the cutting apparatus further comprises:

an encoder synchronized with rotation of the rotary shaft of the first motor to output a pulse signal at each of at least one predetermined rotation angle; and an encoder counter to count the pulse signal from the encoder; wherein the load detector calculates a position of the carriage relative to the work material from the pulse signal counted by the encoder counter and calculates, as the load of the first motor, a position deviation amount that is a difference between the position of the carriage and a target position of the carriage.

15. The cutting apparatus according to claim 14, wherein the controller is configured or programmed to move the carriage relatively to the work material while accelerating the carriage at an initial stage of cutting; and the load detector calculates, as the load of the first motor, the position deviation amount during the accelerating.

16. The cutting apparatus according to claim 9, further comprising:

a carriage motor to move the carriage in a first direction;

a grid roller to transfer the work material in a second direction that is perpendicular or substantially perpendicular to the first direction; and a feed motor to rotate the grid roller; wherein the first motor is the carriage motor or the feed motor.

* * * * *